US007032755B2

(12) United States Patent
Martins

(10) Patent No.: US 7,032,755 B2
(45) Date of Patent: Apr. 25, 2006

(54) DOUBLE CAPACITY HOOK AND CARD SYSTEM

(76) Inventor: Rickey Martins, 5 Rugby Ct., Succasunna, NJ (US) 07876

( * ) Notice: Subject to any disclaimer, the term of this patent is extended or adjusted under 35 U.S.C. 154(b) by 120 days.

(21) Appl. No.: 10/762,777

(22) Filed: Jan. 22, 2004

(65) Prior Publication Data

US 2005/0161361 A1 Jul. 28, 2005

(51) Int. Cl.

| | |
|---|---|
| ***B65D 73/00*** | (2006.01) |
| ***B65D 85/00*** | (2006.01) |
| ***B42F 1/00*** | (2006.01) |
| ***A47F 5/08*** | (2006.01) |
| ***A47F 7/00*** | (2006.01) |

(52) U.S. Cl. ..... 206/461; 206/526; 206/806; 211/57.1; 211/59.1; 211/123; 248/220.41

(58) Field of Classification Search ..... 206/461–471, 206/499, 526, 806; 211/49.1, 54.1, 57.1, 211/59.1, 123; 248/220.21, 220.31, 220.41, 248/220.43

See application file for complete search history.

(56) References Cited

U.S. PATENT DOCUMENTS

| | | | | |
|---|---|---|---|---|
| 3,245,547 | A * | 4/1966 | Felkay | 248/220.41 |
| 3,307,693 | A * | 3/1967 | Bittner | 206/461 |
| 3,483,995 | A * | 12/1969 | Larson | 248/224.41 |
| 3,621,996 | A * | 11/1971 | Seyer | 206/463 |
| 3,638,801 | A * | 2/1972 | Larson | 248/220.41 |
| 3,721,339 | A * | 3/1973 | Seyer | 206/463 |
| 3,861,528 | A * | 1/1975 | Damuth | 206/463 |
| 4,042,095 | A * | 8/1977 | Sawyer | 211/49.1 |
| 4,058,220 | A * | 11/1977 | Torongo | 211/57.1 |
| 4,062,137 | A * | 12/1977 | Herzog | 248/220.41 |
| 4,104,817 | A * | 8/1978 | Herzog | 248/220.41 |
| 4,842,141 | A * | 6/1989 | Segal | 206/462 |
| 5,026,011 | A * | 6/1991 | Hoefkes | 248/220.41 |
| 5,593,036 | A * | 1/1997 | Dyble et al. | 206/462 |
| 5,855,282 | A * | 1/1999 | Hardy | 211/59.1 |
| 6,234,436 | B1 * | 5/2001 | Kump | 248/220.21 |

* cited by examiner

*Primary Examiner*—Bryon P. Gehman
(74) *Attorney, Agent, or Firm*—Walter J. Tencza, Jr.

(57) ABSTRACT

A hook having an extension attached to a base is disclosed. A first package having an enclosure attached to a backing, and a substantially similar second package can be placed on the extension so that the enclosure of the first package is adjacent to the enclosure of the second package and the length taken up by the first and second packages along the extension is about the depth of the first package.

7 Claims, 5 Drawing Sheets

DOUBLE CAPACITY HOOK AND CARD SYSTEM

FIELD OF THE INVENTION

This invention relates to improved methods and apparatus concerning hooks for hanging display and/or retail items.

BACKGROUND OF THE INVENTION

Typically in the prior art single round hooks are used to hold products which are contained in packages which typically have a hard cardboard backing. The cardboard backing of the packages typically have a single hole at the top of the package to allow the single round hook to penetrate the cardboard backing and thus to hang the packages from the single round hook. After one package is slid on the single round hook, another package is placed on the hook in the same manner, so that the second package is stacked and directly aligned over or on top of the first package. This type of stacking can be called vertical stacking. Vertical stacking takes up an undesirable amount of space.

SUMMARY OF THE INVENTION

The present invention, in one or more embodiments provides an apparatus comprising a hook. The hook may be comprised of a base and an extension attached to the base. The apparatus may include a first package having an enclosure attached to a backing, wherein the first package has a depth and a second package having an enclosure attached to a backing, wherein the second package has a depth which is the same as the first package.

The first package and the second package can be placed on the extension so that the enclosure of the first package is adjacent to the enclosure of the second package and the length taken up by the first and second packages along the extension is about the depth of the first package. The length taken up by the first and second packages along the extension may be approximately equal to the depth of the first package plus the depth of the backing of the second package. In one embodiment, the first package is placed on the extension so that the first package will not substantially rotate.

The extension may have an elongated cross section. The backing of the first package may have a slot with an elongated opening into which the extension can be inserted. The extension may project downwards from the base and and may gradually curve upwards.

The present invention in one or more embodiments, also includes a method. The method may include forming a package having an enclosure attached to a backing, wherein the package has a top and a bottom. The method may also include forming a first slot in the top of package, and a second slot in the bottom of the package. A hook can be created with a penetrating end which can penetrate both the first and the second slots. The method may also include hanging the hook on a wall and hanging a package on the hook.

A method is also provided comprising forming a hook comprised of an extension attached to a base, forming a first package having an enclosure attached to a backing, wherein the first package has a depth, and forming a second package having an enclosure attached to a backing, wherein the second package has a depth which is the same as the first package. The first package and the second package can be placed on the extension so that the enclosure of the first package is adjacent to the enclosure of the second package and the length taken up by the first and second packages along the extension is about the depth of the first package.

DETAILED DESCRIPTION OF THE DRAWINGS

Figure 1:
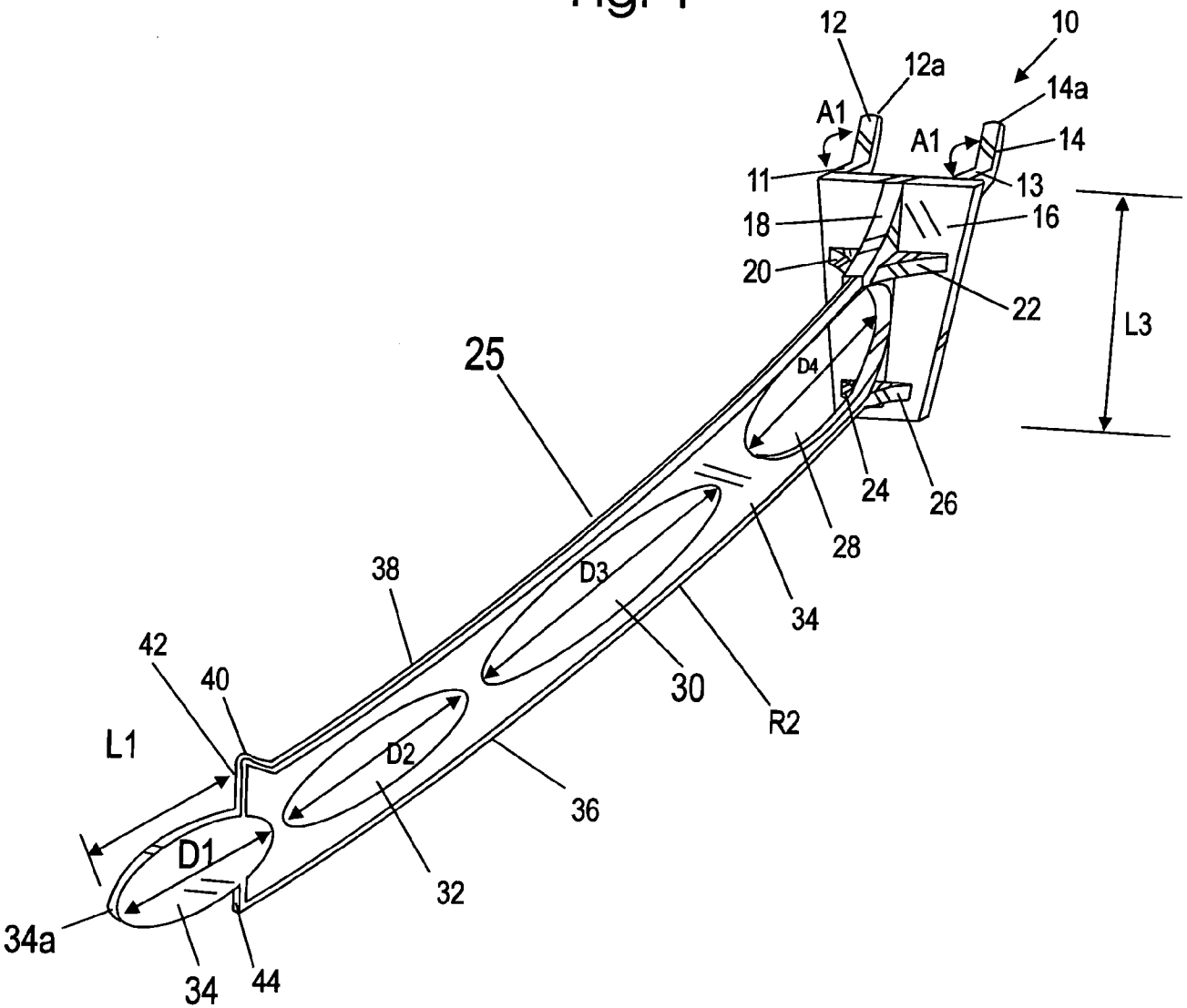
FIG. 1 shows a perspective view of an apparatus or hook in accordance with a first embodiment of the present invention.

FIG. 1 shows a perspective view of an apparatus 10 in accordance with a first embodiment of the present invention. The apparatus 10 can be called a "hook". The apparatus 10 may include prongs 12 and 14, base 16, and extension portion 25.

Prong 12 may be at an angle A1, which may be one hundred and twenty degrees, with respect to a portion 11. Prong 14 may also be at an angle A1, which may be one hundred and twenty degrees, with respect to a portion 13. Portions 11 and 13 may be attached and/or fixed substantially perpendicularly to base 16. Base 16 may have a trapezoid shape. Extension 25 may be attached and/or fixed to base 16 by supports 18, 20, 22, 24, and 26.

Figures 2A, 2B:
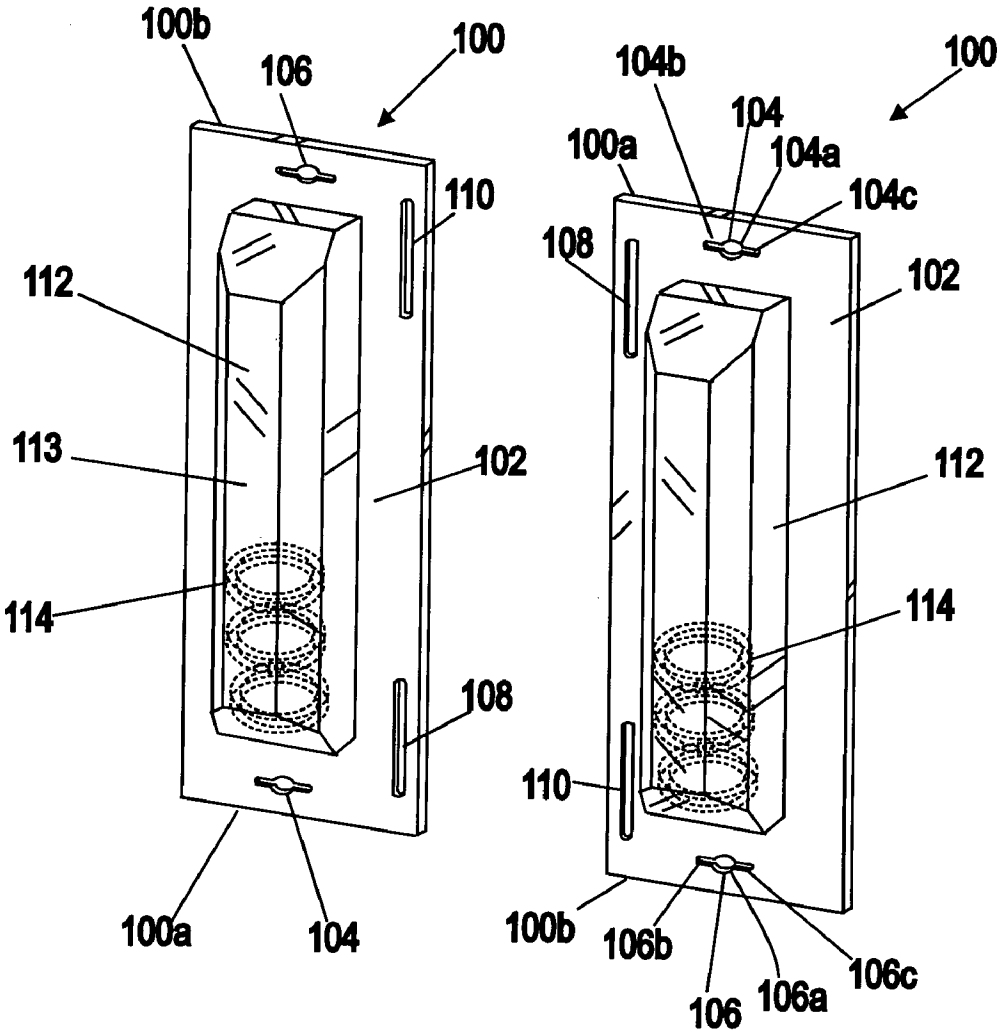
FIG. 2A shows a perspective view of a package which includes a backing, a product enclosure and a product.
FIG. 2B shows a perspective view of the same package as in FIG. 2A, with the package rotated one hundred and eighty degrees.

Extension 25 may include openings 28, 30, and 32, each of which may be shaped in the form of an ellipse or a client's logo shape. A printed information sticker or insert can be placed inside any of the openings 28, 30, or 32. The printed information sticker or insert may provide a name for the product enclosed within, and a part of a package, such as a product 114 enclosed within and a part of package 100 as shown in FIGS. 2A and 2B.

Opening 28 may be an ellipse with a greatest diameter of D4, which may be about 1.86 inches, and with a least diameter which may be about one inch. Opening 30 may be an ellipse with a greatest diameter of D3 which may be about 2.75 inches and a least diameter which may be about one inch. Opening 32 may be an ellipse with a greatest diameter of D2 which may be about 2.20 inches and a least diameter which may be about one inch. The portion 34 may be solid and a sticker or insert identifying the product, such as insert 92 shown in FIG. 3 specifying "ACME" as the product name. In addition a UPC (Universal Product Code) label can go on portion 34, such as on the other side of portion 34.

The extension 25 may include a top edge 38, an upwardly sloping portion 40, edges 42 and 44, edge 34*a*, and bottom edge 36. The extension 25 may have a solid interior portion 34.

The apparatus 10 may have a length from edge 34*a* to the ends 12*a* and 14*a* of the prongs 12 and 14 of ten inches more or less. The distance from the edge 34*a* to the portion 40 may be L1, which may be 1.28 inches.

FIG. 2A shows a perspective view of a package 100 which includes a backing 102, a product enclosure or envelope 112, and a product 114 shown in dashed lines. FIG. 2B shows a perspective view of the same package as in FIG. 2A, with the package rotated one hundred and eighty degrees. In this example, the product 114, may be a plurality of rubber bands. The enclosure 112 may be a clear plastic enclosure which allows one to view the product 114. The enclosure 112 and the backing 102 form a sealed chamber or cavity 113 in which the product 114 resides.

The package 100 is also comprised of slots 104, 106, 108, and 110. Slot 104 has circular opening 104*a*, and rectangular openings 104*b* and 104*c*. Similarly slot 106 has circular opening 104*a*, and rectangular openings 104*b* and 104*c*. The package 100 is also comprised of slots 108 and 110.

When the package 100 is in the position shown in FIG. 2A, the slot 106 is centrally located on top, the slot 104 is centrally located on the bottom, the slot 110 is in the upper right hand corner, and the slot 108 is in the lower right hand corner, of the package 100. When the package 100 is in the position shown in FIG. 2B, the slot 104 is centrally located on top, the slot 106 is centrally located on the bottom, the slot 108 is in the upper left hand corner, and the slot 110 is in the lower left hand corner, of the package 100.

Figure 2C:
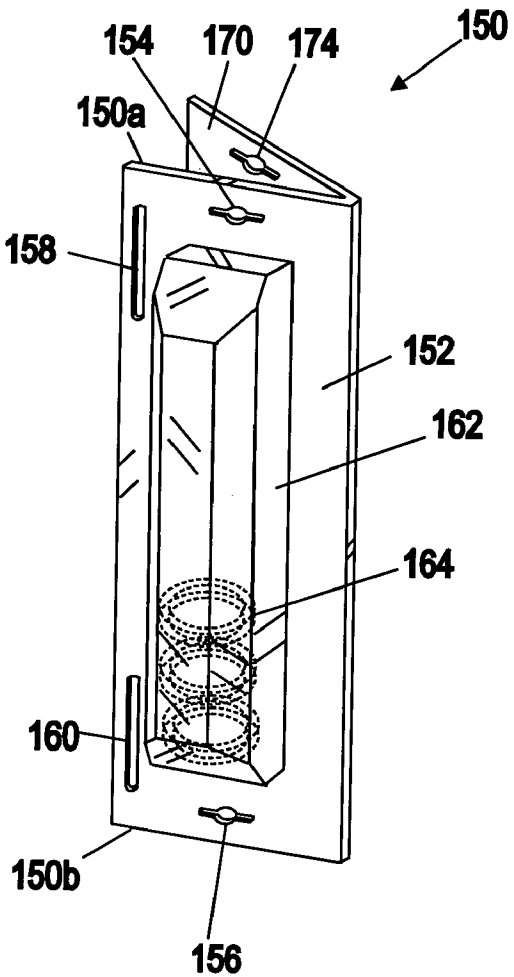
FIG. 2C shows a perspective view of another package for use with one or more embodiments of the present invention.

FIG. 2C shows a perspective view of a package 150 which includes a portion 152, a product enclosure or envelope 162, and a product 164 shown in dashed lines. The package 150 may have slots 154, 156, 158, and 160 which may be similar to slots 104, 106, 108, and 110 of package 100. The package 150 may have a top 150*a* and a bottom 150*b*. The package 150 can be used in place of the package 100. In this example, the product 164, may be a plurality of rubber bands. The enclosure 162 may be a clear plastic enclosure which allows one to view the product 164. FIG. 2C may be an example of a clam shell type backage. The package 150 may include back portion or backing 170. The package 150 may be clear plastic and may be closed by sealing or snapping back portion 170 to portion 152, thereby providing a backing and behind enclosure 162. The product is at that point enclosed within portion 170 and enclosure 162. The portion 170 has slots (not shown) which align with slots 158 and 160 when the portion 170 is closed behind the enclosure 162. The portion 170 also has a slot 174 which aligns with slot 154 and another slot (not shown) which aligns with slot 156. The package 150 has a top 150*a* and a bottom 150*b*. The package 150 can be flipped, so that the bottom 150*b* is on the top and the top 150*a* is on the bottom, and the package 150 can be placed on the apparatus 10 in either of the two orientations.

Figure 3:
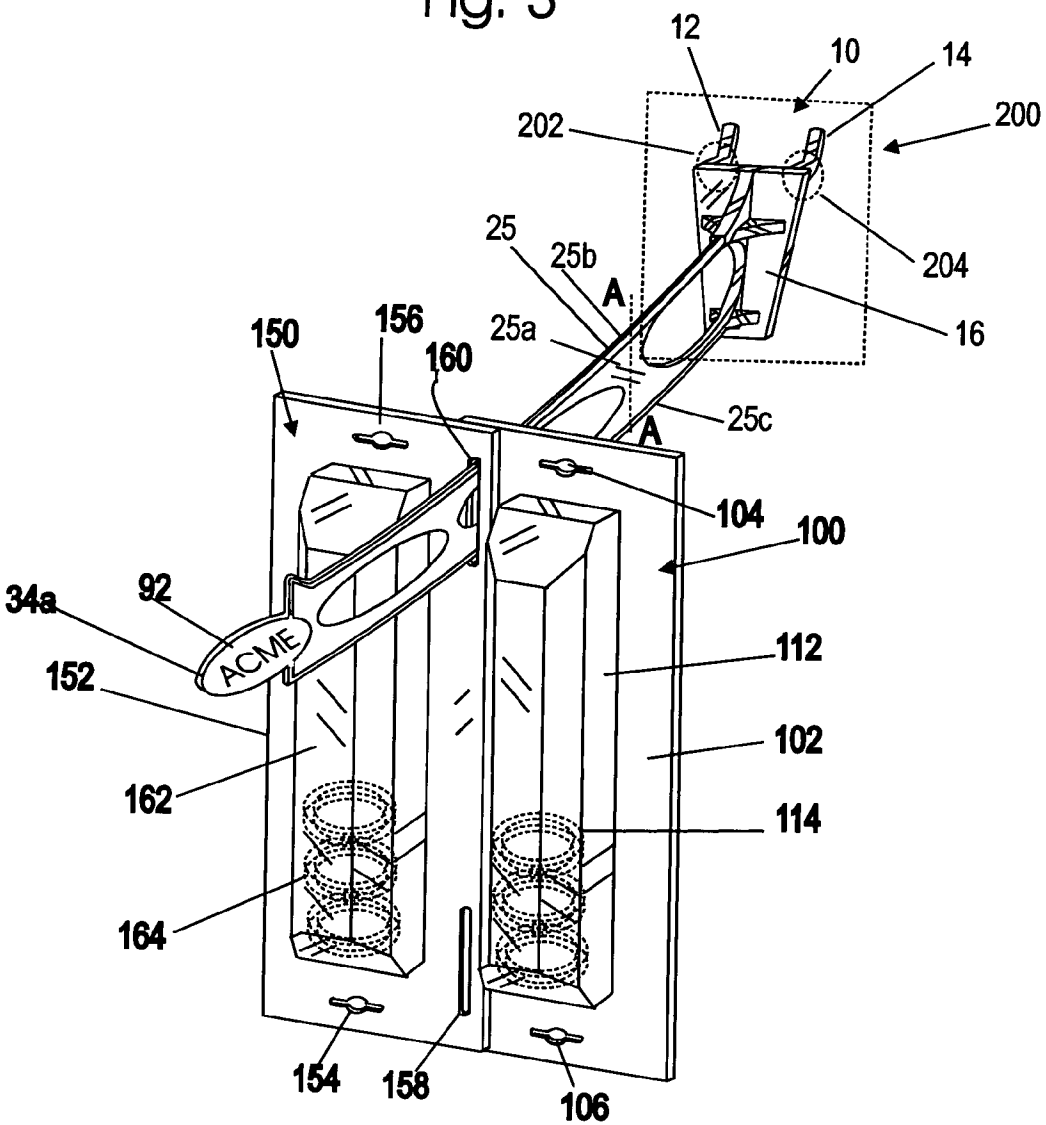
FIG. 3 shows a perspective view of the apparatus of FIG. 1 with the package as shown in FIG. 2B hanging from the apparatus of FIG. 1 and with another package hanging from the apparatus of FIG. 1.

FIG. 3 shows a perspective view of the apparatus or hook 10 of FIG. 1 with the package 100 as shown in the state of FIG. 2B hanging from the apparatus 10 and with another package 150 hanging from the apparatus 10 of FIG. 1. The package 150 can be identical to the package 100. The package 150 may have slots 154, 156, 158, and 160. The package 150 may have an enclosure 162 attached to a backing 152. The package 150 may have a product 164 inside a cavity or chamber 163 defined by the backing 152 and the enclosure 162. The particular configuration of the packages 100 and 150 and the hook or apparatus 10 allows the packages 100 and 150 to be substantially "horizontally" aligned which results in less space and/or less depth being taken up on the hook 10. This allows more packages similar to packages 100 and 150 to be placed on the hook or apparatus 10.

In the example of FIG. 3, the package 100 is placed on the hook or apparatus 10 first. The end 34*a* of the apparatus 10 is inserted through the slot 108 of the package 100 and the package 100 is slid onto the extension 25 towards the base 16. The package 100 can be slid towards the base 16 until it contacts the base 16. After the package 100 has been placed onto the extension 25, the package 150 can be placed on the extension 25. The end 34*a* is inserted through the slot 160 of the package 150 and the package 150 is slid on the extension 25 towards the base 16. The package 150 can be slid on the extension 25 until a portion of the package 150 contacts a portion of the package 100. The package 150 overlaps the package 100 by a length L4, as shown by FIG. 3. The packages 100 and 150 are designed so that the package 150 typically does not overlap the enclosure 112. This arrangement allows the combination of the two packages 100 and 150 to have about the same depth, D4, on the apparatus or hook 10, as a single package, such as package 100. The actual depth of the two packages together is D4, the depth of one package, plus D5, the depth of the backing, such as backing 102. However, the backing, such as backing 102, typically has a very small depth when compared with the enclosure, such as 112, for the package, such as 100.

FIG. 3 also shows a pegboard 200 including holes 202 and 204, shown in dashed lines. The prongs 12 and 14 can be inserted into the holes 202 and 204 of the pegboard 200. In this manner the apparatus or hook 10 can be held up by the pegboard 200. The packages 100 and 150 can be held on the extension 25 as shown in FIG. 3.

Figure 4:
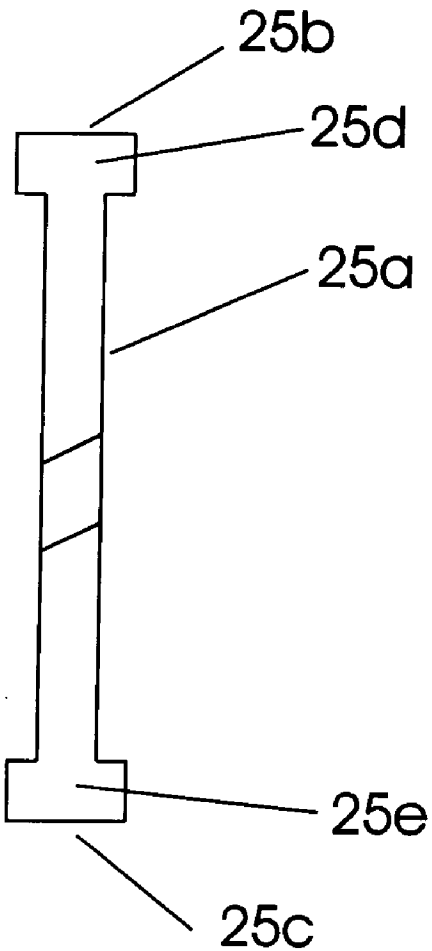
FIG. 4 shows a substantially rectangular cross section for an extension of the apparatus or hook of FIG. 1.

The shape of the apparatus or hook 10's cross section can vary, but generally it should hold the carded product or item, such as package 100 or package 150, from leaning off plumb. "Plumb" means that the carded product or item, such as package 100 or 150, should be substantially perpendicular to the ground for best display purposes. The extension 25 cross section, such as along dashed line A—A shown in FIG. 3, may be elongated and may be substantially rectangular. For example, the extension 25 may have a cross section 25*a* shown in FIG. 4, which may be located at line A—A in FIG. 3, which is elongated and substantially rectangular. The cross section 25*a* may include a ridge 25*b* on the top and/or a ridge 25*c* on the bottom. The ridges 25*b* and 25*c* may be eliminated and the cross section 25*a* may be replaced by an exactly rectangular cross section and/or other types of elongated cross sections may be used. The apparatus or hook 10 prevents unbalanced product from angling off plumb. The extension 25, unlike round hooks, has an elongated and/or rectangular cross section, such as 25*a*, which fits snugly into an elongated and or rectangular slot opening such as slots 108, 110, 158, and 160. This elongated and/or rectangular cross section does not allow the packages 100 or 150 to rotate and thus keeps the packages 100 and 150 upright, plumb, and/or substantially parallel to the base 16 and substantially perpendicular to ground. This upright positioning keeps the packages 100 and 150 in the most optimum display condition.

The extension 25 is typically curved. The extension 25 initially projects from the base 16 at an angle which is not perpendicular to base 16 but rather at an angle, A2, which may be about one hundred and four degrees with respect to the base 16, i.e. fourteen degrees lower than perpendicular to base 16. The extension 25 may gradually curve upward.

Rear or mounting portion of hook or apparatus 10, can have any detail to fit any system or peg wall. For example, the prongs 12 and 14, which can be called a rear or mounting portion, can be replaced by any other type of rear or mounting portion. The apparatus 10 or hook can fit molded wall systems.

The slots 104, 106, 154, and 156 are provided to fit existing store hooks (not shown). In this manner, the packages 100 and 150 can be hung on pre-existing hooks, such as round hooks, or on apparatus or hook 10.

Figure 5:
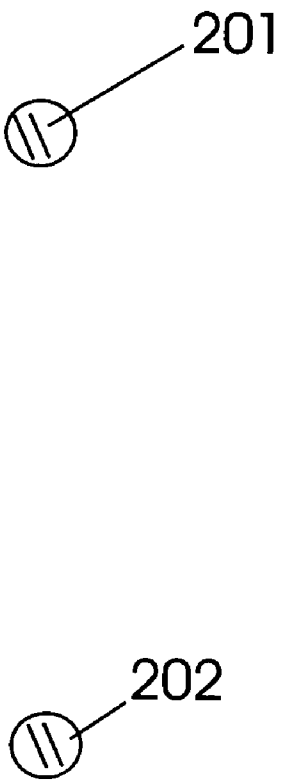
FIG. 5 shows cross section for two wires to be used instead of the apparatus of FIG. 1 in accordance with another embodiment of the present invention.

The hook 10 can be replaced by two parallell wires. Each of the wires may have a round cross section. For example, FIG. 5 shows a cross section of two wires 201 and 202 which may be spaced apart similar to space between portions 25*d* and 25*e* of apparatus or hook 10 shown in FIG. 4.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a base, the base having a front surface and a rear surface opposite the front surface;

an extension attached to the front surface of the base and extending outward from the front surface of the base;

a first prong attached to the rear surface of the base and extending outward from the rear surface of the base, the first prong having a first tip, the first prong adapted to be inserted into a first hole of a pegboard;

a second prong attached to the rear surface of the base and extending outward from the rear surface of the base, the second prong having a second tip, the second prong adapted to be inserted into a second hole of the pegboard;

wherein the first prong and the second prong are spaced apart from each other and are substantially parallel to each other;

wherein the extension has a first dimension, a second dimension, and a third dimension, wherein the first, second, and third dimensions are substantially perpendicular to one another;

wherein the first dimension is greater than the second dimension and the second dimension is greater than the third dimension;

wherein the extension extends outward from the front surface of the base in the first dimension;

wherein the second dimension is substantially perpendicular to a line segment which includes the first tip of the first prong and the second tip of the second prong;

wherein the third dimension is substantially parallel to the line segment; and further comprising a first package having an enclosure attached to a first backing;

a second package having an enclosure attached to a second backing;

and wherein the first package and the second package can he placed on the extension so that the enclosure of the first package is adjacent to the enclosure of the second package and at least a portion of the first backing lies on top of and comes in contact with at least a portion of the second backing;

wherein the first package can be placed on the extension so that the first package will not substantially rotate;

wherein the first backing of the first package has a first slot with an a first elongated opening into which the extension can be inserted;

wherein the first backing of the first package has a second slot with a second elongated opening into which the extension can be inserted;

wherein the first backing of the first package has a top, a bottom, a first side, and a second side opposite the first side;

wherein the first slot and the second slot are located nearer the first side than the second side and the first slot and the second slot are substantially parallel to the first side;

wherein the first slot is located nearer the top than the bottom;

wherein the second slot is located nearer the bottom than the top;

wherein the first slot an the second slot are substantially the same size and shape;

wherein the first backing of the first package has a third slot, wherein the third slots is substantially parallel to the top of the backing and nearer the top than the bottom of the backing;

and wherein the extension cannot be inserted into the third slot.

2. The apparatus of claim 1 wherein the extension projects downwards from the front surface of the base in the first dimension and gradually curves upwards.

3. The apparatus of claim 1 further comprising a printed tangible material located along the second dimension of the extension; and wherein the printed tangible material identifies a name of a product.

4. The apparatus of claim 1 further comprising a painted tangible material located along the second dimension of the extension; and wherein the printed tangible material identifies a name of a product;

and wherein the first package contains the product and the second package contains the product.

5. The apparatus of claim 1 wherein the first backing of the first package has a fourth slot, wherein the fourth slot is substantially parallel to the bottom of the first backing and nearer the bottom than the top of the first backing;

and wherein the extension cannot be inserted into the fourth slot.

6. An apparatus comprising a first package having an enclosure attached to a first backing;

wherein the first backing has a first slot, a second slot, a top, a bottom, a first side, and a second side opposite the first side;

wherein the first slot and the second slot are located nearer the first side than the second side and the first slot and the second slot are substantially parallel to the first side;

wherein the first slot is located nearer the top than the bottom;

wherein the second slat is located nearer the bottom than the top;

wherein the first slot and the second slot are substantially the same size and are adapted to have an extension inserted through them;

wherein the first backing of the first package has a third slot, wherein the third slot is substantially parallel to the top of the first backing and nearer the top than the bottom of the first backing and wherein the third slot is sized so that the extension cannot be inserted through the third slat.

7. The apparatus of claim 6 further wherein the first backing of the first package has a fourth slot, wherein the fourth slot is substantially parallel to the third slot and nearer the bottom than the top of the first backing; and wherein the fourth slot is substantially the same size and shape as the third slot.

* * * * *